US008087653B2

(12) United States Patent
Silberbauer

(10) Patent No.: US 8,087,653 B2
(45) Date of Patent: Jan. 3, 2012

(54) METHOD AND ARRANGEMENT FOR PRODUCING PRINTED PRODUCTS

(75) Inventor: Guenther Silberbauer, Uerkheim (CH)

(73) Assignee: Mueller Martini Holding AG, Hergiswil (CH)

( * ) Notice: Subject to any disclaimer, the term of this patent is extended or adjusted under 35 U.S.C. 154(b) by 0 days.

(21) Appl. No.: 12/604,999

(22) Filed: Oct. 23, 2009

(65) Prior Publication Data

US 2010/0104400 A1 Apr. 29, 2010

(30) Foreign Application Priority Data

Oct. 23, 2008 (EP) ..... 08405266

(51) Int. Cl.
*B42C 19/02* (2006.01)

(52) U.S. Cl. ..... 270/52.02; 270/1.01; 270/1.03; 270/1.02

(58) Field of Classification Search ..... 270/1.01, 270/1.02, 12, 1.03, 52.02
See application file for complete search history.

(56) References Cited

U.S. PATENT DOCUMENTS

| | | | | |
|---|---|---|---|---|
| 2,951,697 | A | 9/1960 | Bernart et al. | |
| 4,018,325 | A | 4/1977 | Rejsa | |
| 4,925,173 | A | 5/1990 | Lindblom et al. | |
| 5,267,821 | A | 12/1993 | Bodart et al. | |
| 5,634,633 | A * | 6/1997 | Graushar | 270/58.05 |
| 5,988,620 | A * | 11/1999 | Graushar | 270/1.02 |
| 6,171,044 | B1 | 1/2001 | De La Torre | |
| 6,302,388 | B1 * | 10/2001 | Graushar et al. | 270/1.02 |
| 6,338,603 | B1 * | 1/2002 | Cerruti | 412/1 |
| 7,413,175 | B2 * | 8/2008 | Levine et al. | 270/58.08 |
| 7,441,762 | B2 * | 10/2008 | Kearns | 270/52.02 |
| 7,503,555 | B2 * | 3/2009 | Dobrovolsky | 270/58.07 |
| 7,758,036 | B2 * | 7/2010 | Levine et al. | 270/58.08 |
| 2006/0028662 | A1 * | 2/2006 | Dobrovolsky | 358/1.9 |
| 2006/0225570 | A1 * | 10/2006 | Levine et al. | 95/109 |
| 2008/0031706 | A1 * | 2/2008 | Silberbauer | 412/19 |

FOREIGN PATENT DOCUMENTS

| | | | |
|---|---|---|---|
| DE | 3829355 | A1 | 7/1989 |
| EP | 0 384 119 | A2 | 8/1990 |
| EP | 0 685 420 | A1 | 12/1995 |
| EP | 0 893 378 | A1 | 1/1999 |
| EP | 0 895 872 | | 2/1999 |
| EP | 1 155 875 | A2 | 11/2001 |

(Continued)

OTHER PUBLICATIONS

European Search Report issued in Priority Application No. 08405266.1.

(Continued)

*Primary Examiner* — Patrick Mackey
(74) *Attorney, Agent, or Firm* — Venable LLP; Robert Kinberg; Leigh D. Thelen

(57) ABSTRACT

A method for producing printed products with an arrangement including at least one printing press to produce book blocks, at least one conveying device to convey the book blocks, at least one processing device to provide each respective book block with a respective cover, and a control unit to control the production of the book blocks. The method includes producing each respective cover in advance of each respective book block production, supplying each cover to at least one storage unit, and following the supplying of each cover to the storage unit, triggering at least one printing press by the control unit to produce the respective book block on the at least one printing press.

21 Claims, 2 Drawing Sheets

FOREIGN PATENT DOCUMENTS

| | | | |
|---|---|---|---|
| EP | 1 199 187 | A1 | 4/2002 |
| EP | 1 288 015 | | 3/2003 |
| EP | 1 880 863 | | 1/2008 |
| EP | 1880863 | A1 * | 1/2008 |
| GB | 2 395 682 | A | 6/2004 |
| WO | WO-2004/039711 | A1 | 5/2004 |
| WO | WO-2006/020501 | | 2/2006 |

OTHER PUBLICATIONS

European Search Report, issued Jan. 16, 2007, in EP06405313, and English translation.

* cited by examiner

METHOD AND ARRANGEMENT FOR PRODUCING PRINTED PRODUCTS

CROSS REFERENCE TO RELATED APPLICATION

This application claims the priority of European Patent Application No. 08405266.1, filed on Oct. 23, 2008, the subject matter of which is incorporated herein by reference.

FIELD

An embodiment of the invention relates to a method for producing printed products with the aid of an arrangement including a control unit, at least one printing press for producing book blocks, at least one conveying device for conveying the book blocks and at least one further processing device in which respectively one book block is provided with a cover.

Various printing methods and binding methods are known for producing printed products in the form of books, brochures, magazines and catalogs, wherein very different types of paper, different formats and different finishing processes are used. A high quality is generally expected for the printed products, even for extremely small and digitally produced editions. Furthermore required is a highly flexible method, which makes it possible to produce editions ranging from very large to very small editions, right down to a single printed product. In particular the digital printing technique has proven itself in that case since this technology makes it possible to print a complete product in a single sequence.

It is furthermore known that the individual steps for producing a book can be realized successively (inline) and can also be interlinked. However, there is a problem in particular when producing covers for softcover books or hardcover books in which the covers must generally be produced ahead of time since these processes, as a rule, are less suitable for a networked operation. For example, separating devices, such as silicon oils, are used for producing covers, wherein these oils must vaporize prior to the laminating process, thereby requiring a specific lead processing time.

A method is disclosed in co-owned European patent document EP 1288015 A1, for which printed sheets are gathered in a collating or gathering device to be formed into book blocks that are subsequently supplied to a perfect binder. The book block spines are then processed mechanically in the perfect binder and are provided with adhesive as well as with a cover.

Co-owned European patent document EP 1880863 A1 furthermore discloses a method for which the covers are supplied to a storage unit, located along the path to the processing machine. These book blocks are respectively provided with identifying markings. Once a book block has been identified, the control unit requests the associated cover and supplies this cover to the processing machine.

According to International Patent Application publication WO 2006/020501 A2, either a book block or a cover is alternately produced ahead of time in a first printing press. Once the printing is completed and a corresponding quality control realized, the first printing press transmits a signal to the control unit which then triggers the printing of the associated book cover or the book block in a second printing press. If the cover is produced ahead of time, it is moved from the first printing press initially to an intermediate storage unit. Once the production of the associated book block is completed, the pre-produced cover is withdrawn from the intermediate storage unit and transported to downstream arranged binding station where it is combined with the book block to form a printed product.

However, if a malfunction occurs during the further travel of the cover along the path and after the signal has been transmitted by the first printing press, the operation already in progress for printing the book block can no longer be stopped. In that case, the book block must either be sent to an intermediate storage until the associated cover is produced or it must be removed again from the process.

When using digital printing presses for successively producing printed products, however, the process of reintroducing previously removed book blocks into the binding process is very involved. If the intermediate storage is not sufficient for the buffering, then the second printing press must also be stopped until the malfunction has been corrected.

SUMMARY

An embodiment of the present invention provides a method of the aforementioned type which permits a more economic production of even the smallest editions of printed products, up to a single product. The production of the covers may be efficient and automated, if possible, wherein it may also be possible to automatically control the orders and to monitor the process.

The above and other objects are accomplished according to one aspect of the invention, wherein there is provided a method for producing printed products with an arrangement including at least one printing press to produce book blocks, at least one conveying device to convey the book blocks, at least one processing device to provide each respective book block with a respective cover, and a control unit to control the production of the book blocks, the method comprising: producing each respective cover in advance of each respective book block production; supplying each cover to at least one storage unit; following the supplying of each cover to the storage unit, triggering at least one printing press by the control unit to produce the respective book block on the at least one printing press.

According to another aspect of the invention, there is provided an arrangement for producing printed products, comprising: at least one printing press to produce book blocks; at least one storage unit, wherein at least one cover is supplied to the storage unit; a control unit responsive to the supplying of each respective cover to the at least one storage unit to trigger production of the book blocks on at least one of the printing presses once the supplying is detected; at least one processing device; and at least one conveying device to convey each cover from the at least one storage unit to the at least one processing device, wherein each book block is furnished with the respective cover in the processing device.

Thus, in accordance with the subject matter of the application, the covers may be produced ahead of time, meaning before the book blocks are produced, and may then be supplied to a storage unit. As a result of the cover being supplied to the storage unit, the control unit then triggers the production of a book block in at least one printing press. If malfunctions occur along the path for conveying the cover from the cover printing press to the storage unit, these malfunctions do not affect the production of the associated book block because a command for producing the book block is triggered only if the cover has arrived at the storage unit. In this way, the production process becomes more resistant to malfunctions and can be monitored easier.

For this operation, the covers may be deposited individually in the at least one storage unit and may be identified while they are being deposited. The arrangement consequently need not have knowledge of the covers during the production. Rather, the covers may also be produced ahead of time in an external printing operation and may then be supplied by way of the storage unit to the arrangement. As soon as a cover is identified, the production of a book block is triggered, thus ensuring a relatively fast, time-saving processing sequence. In an alternate embodiment, the control unit may select one of the identified covers and, based on this selection, may trigger the production of a book block which may result in a higher flexibility during the production of the printed products and a better utilization of the printing presses.

The control system for this arrangement in particular is a so-called "workflow system," in which the storage unit functions as the control element that triggers the production of the book block. The storage unit in this case has a capacity that may be adapted to the workflow system, meaning it has a corresponding capacity for holding covers.

For example, if the length of the processing path between the respective printing press and the further processing stations amounts to 50 book cycles, then the storage unit may be able to accommodate 50 covers in addition to a safety reserve. The conveying device may ensure that a book block produced as a result of a cover located inside the storage unit is supplied on time to the further processing from the capacity of the storage unit.

It may not be necessary for the conveying device to be fed information regarding the pre-processing and the post-processing operations. Rather, for taking over a book block, it may be sufficient if the conveying device knows at which further processing station the book block must be deposited. The conveying device may also be fed the information regarding the latest point in time at which the book block may reach the destination location. For this, the conveying device may be provided with a separate intelligence device that regulates the conveying of the book blocks, sets respective priorities, and may automatically ensure that a book block reaches the destination on time. The book blocks may not need to be stored and sequences may not need to be considered. With an embodiment of the invention in which the covers may be produced ahead of time, may be stored in the intermediate storage unit, and the production of corresponding book blocks is then triggered, it may be possible to have an arrangement or a system where the individual operating steps may be networked, to be sure, but may selectively be operated individually through uncoupling of the logic. The storage unit may be provided with several storage areas from which respectively one cover can be recalled and supplied to the further processing.

The covers, which may have very different designs and can be produced in many different ways, can be intended for softcover books or also for so-called hardcover books that may be produced either digitally or conventionally, for example with the aid of offset technology.

According to one embodiment of the invention, the covers may be supplied to the storage unit with the aid of a feeder. Alternatively, they also be supplied with different device.

BRIEF DESCRIPTION OF THE DRAWINGS

The present invention will be more readily understood from the following detailed description when read in conjunction with the accompanying drawings, in which.

DETAILED DESCRIPTION

Figure 1:
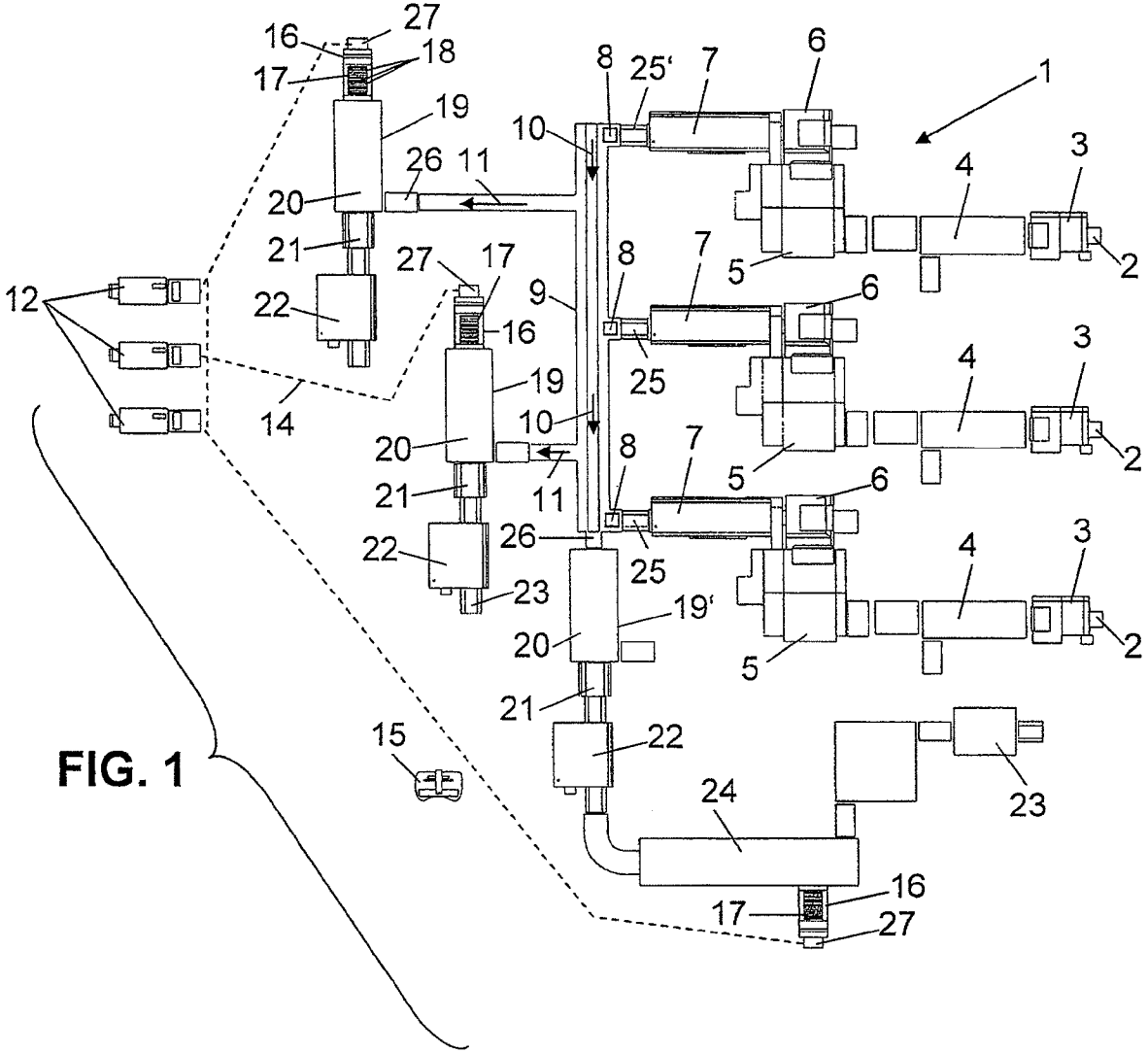
FIG. 1 is a schematic view from above of an arrangement according to the invention.
Figure 2:
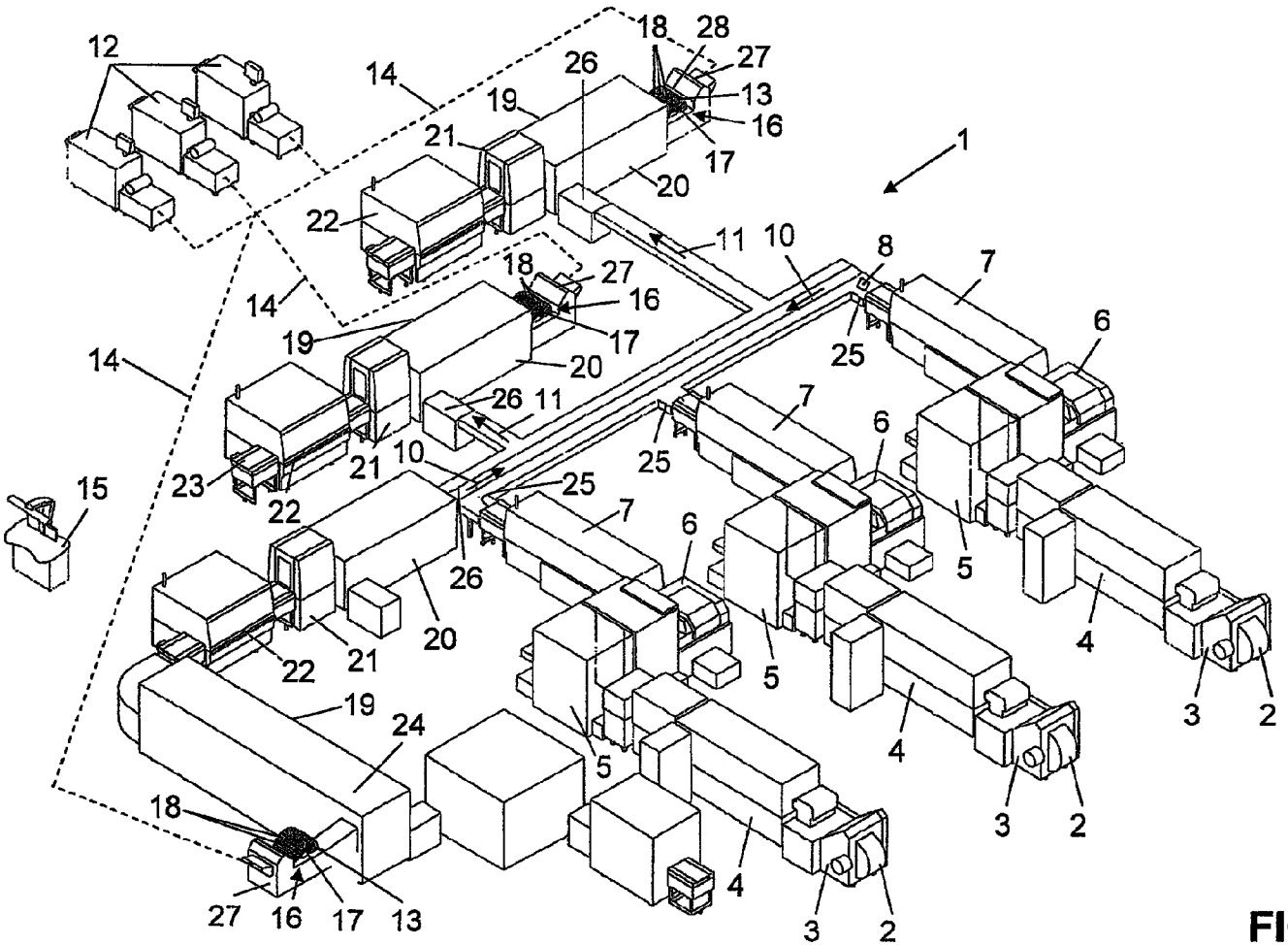
FIG. 2 is a schematic three-dimensional view of the arrangement according to FIG. 1.

According to FIGS. 1 and 2, the arrangement 1 includes three printing presses 4 which may be digital printing presses. The paper to be printed on is respectively supplied to the printing presses 4 by an unwinding device 3 for unwinding a paper roll 2. However, it is also possible to connect a printing press, not shown herein, which utilizes precut individual sheets. The printed-on paper webs may be supplied in a manner known per se to a folding machine 5, as well as a cutting and folding device 6. The printed sheets created in this way may be collated in a collating device 7, so that a book block 8 is finally obtained. If a single-sheet fed printer is used, it may also be provided with a stacking device and the collating device 7 may be omitted. The aforementioned devices as well as the printing presses may be known per se to one skilled in the art and need not be explained further herein. The number of printing presses 4 is optional, per se, wherein an arrangement having only one printing press 4 is also conceivable.

The arrangement 1 is provided with three cover production devices 12 in which the covers 13 (FIG. 2) may be produced in a manner known per se. The covers 13 may include, for example, digitally imprinted sheets and may be embodied as so-called "softcovers" or "hardcovers." The cover production devices 12 may furthermore comprise a laminating device. A hard cover may furthermore include different components which are known to one skilled in the art. A corresponding process for producing hard covers may furthermore be part of such a cover production device, but need not be directly connected thereto. As an alternate to being supplied by the internal cover production devices 12, the covers 13 may also be supplied from an external source. The manner and production of where the covers 13 are produced may not be significant. Of course, a series production that permits supplying the required covers 13 should be possible.

The arrangement 1 furthermore comprises three processing devices 19, 19' with respectively one storage unit 16. The storage units 16 may be drum storage units provided with a wheel 17 that contains several compartments 18, as disclosed in European patent document EP 1880863 A1. The covers 13, produced in the cover-producing devices 12, may be supplied to these storage units 16 with the aid of respectively one feeder 27. The covers 13 may be moved from the cover-producing devices 12 to the feeders 27, either manually or with the aid of a transporting device 14 which is indicated with dashed lines herein.

The storage units 16 and the feeders 27 may form a single module that may be arranged on or directly in front of the further processing device 19, 19'. To identify the covers 13 assigned to the respective storage unit 16, the feeders 27 may be furthermore provided with an identification device 28 (FIG. 2). The identification device 28 may comprise a reading device for reading a bar code that may be imprinted on the respective cover 13. Of course, other identifying elements may also be used in place of bar codes, such as transponders, magnetic strips or different types of elements that may store information, wherein a clear text with numbers or letters may also be detected. If different feeders may be used in place of the feeders 27 for supplying the covers 13, then the identification device 28 for identifying the covers 13 may be arranged on the different feeders.

The additional processing devices 19 may be respectively provided with a binding device 20, a cooling tower 21 or another suitable cooling section, a three-way trimmer 22, as well as a delivery section 23 from which the finished printed product may be removed. The individual book blocks 8 may be bound inside binding devices 20 and may be provided with a cover 13, wherein optional binding methods may be used per se. The book blocks 8 may be supplied with a conveying device 9 to the binding device 20, either in the direction of the arrows 11 via a side arm of the conveying device 9 or also in the direction of arrows 10, meaning via the main conveying flow.

The conveying device 9 may be provided with several takeover locations 25, 25' where respectively one book block 8 may be taken over by the collating device 7, for example, and may then be transported in the direction of the arrows 10, 11. It may furthermore be provided with several discharge locations 26 where respectively one book block 8 may be supplied to a further processing device or processing device 19, 19'. The conveying device 9 may be realized as a belt conveyor, wherein grippers or similar elements in principle may also be used for the conveying.

The controlled conveying device 9, shown in FIGS. 1 and 2 in a horizontal plane, may also be embodied in all other dimensions and may convey the book blocks 8 toward the top or toward the bottom. For example, the conveying device may identify a book block 8 with the aid of a reading device and may supply it to a further processing device 19, 19', wherein the information relating to the destination may accompany the book block 8 in the form of a bar code or a data matrix code, or the information may also be transmitted by a control unit. A book block 8 may be supplied, for example from the takeover location 25' to the further processing device 19', which may differs from the other processing devices 19 in that it comprises an encasing mechanism 24 for encasing the printed products with a hard cover. The further processing devices 19, 19' may thus be embodied identical or different.

The arrangement 1 furthermore comprises a control station in the form of a control unit 15. A control unit 15 of this type may also comprise a workflow system that receives book data, production information or process information from a super-imposed system. One skilled in the art should be familiar with a super-imposed system of this type in the form of a management information system (abbreviated: MIS). Of course, data received from a client can also be input manually at the control station by the operating personnel.

An embodiment of the method according to the invention may be explained by the following example: A client or a publisher may place an order for printed products, for example an order involving 1000 printed products with 975 different titles. This order may then be assigned to an existing production unit, or a new production unit may be created. A production unit may, for example, include a single order, a collection of orders, or a work shift and may be planned with the aid of the management information system or may be input accordingly at the workflow system or the control unit 15.

The production unit may be pre-sorted with the aid of the MIS, based on specific criteria, or may be sorted by the workflow system or a different suitable system. For the exemplary embodiment, a workflow system in the control station may be responsible for the sorting. A sorting of this type is useful for grouping the printed products to be produced according to specified criteria, for example the type of paper, the folding diagram and the like. With the sorting, the production unit is defined and is stored in this form for a later processing of the order.

In a following step, the workflow system activates the cover-producing devices 12 to start production of the corresponding covers 13, wherein the production sequence may be specified in the production unit. Once the covers are produced, they may be stored temporarily, for example on pallets, or on a grate or carriage, thus completing the so-called pre-production process.

The subsequent feeding of the covers 13 to the storage unit 16 may take place either automatically or with the aid of a conveying device arranged between the cover producing device 12 and the storage unit 16, or a machine operator may deliver the covers 13 to the feeder 27 of a storage unit 16. The feeder 27 may be provided with a bin, not shown herein, for accommodating the covers 13. The covers 13 may be separated in the feeder 27, may be identified with the reading device, and may then be supplied to the compartments 18 on the storage wheel 17. Each cover 13 may thus be identified and assigned to a storage area. The covers 13 may be administered by a control unit for the storage unit 16, not shown herein, or by the binding apparatus 20 that may be connected to the control unit 15.

The workflow system may be kept informed continuously of which covers 13 may be supplied to which compartment of the storage unit 16. As soon as a cover 13 is known to the workflow system, the system may trigger the production of a corresponding book block 8 in a suitable printing press 4. In an alternate embodiment thereto, the control unit 15 may also select one of the identified covers 13 and, based on the selected cover 13, may trigger the corresponding production of a book block 8. According to another embodiment, the cover 13 may be provided with a control code that may be read out or with an identifying feature, which may trigger the production of a book block 8 on a corresponding printing press 4 once the identification has been made.

The book block 8 may then be produced and transferred to the conveying device 9 at a takeover location 25, 25'. The conveying device 9 may convey the book block 8 to the respective further processing device 19, 19' and may automatically control the time and number of machine cycles. The condition to be met in this case is that the book block 8 may be supplied to the further processing device 19, 19' before the storage unit 16 revolves once. As soon as the book blocks 8 are fed to the further processing device 19, 19', the associated cover 13 may also be removed from the storage unit 16.

The covers 13 stored in the storage units 16 may be called up at any time, so that the further processing device 19, 19' may be provided during each operating cycle with a cover 13 from the respective storage unit 16, regardless of where the respective compartment 18 is located at the time. Accordingly, the capacity of the storage unit 16 may be comparatively high. The fact that the storage unit 16 may be arranged on the respectively used further processing device 19, 19', or directly in front of this device, means that the covers 13 may have a short conveying path from the storage unit 16 to the binding device 20, which may clearly reduce the danger of a malfunction occurring along the conveying path for the covers 13, meaning after the command for printing the associated book block 8 is triggered.

Once the intended cover 13 is combined with the book block 8, the control unit 15 or the workflow system may be informed that the printed product has been produced successfully. The workflow system furthermore may be used to control subsequent processes, such as the further transport of the printed products to a logistic system and the shipping.

It will be understood that the above description of the present invention is susceptible to various modifications, changes and adaptations, and that the same are intended to be comprehended within the meaning and range of equivalents of the appended claims.

What is claimed is:

1. A method for producing printed products with an arrangement including at least one printing press to produce book blocks, at least one conveying device to convey the book blocks, at least one processing device to provide each respective book block with a respective cover, and a control unit to control the production of the book blocks, the method comprising:

producing each respective cover in advance of each respective book block production;

supplying each cover to at least one storage unit;

depositing each respective cover in the at least one storage unit;

identifying the respective cover during the depositing of the respective cover in the at least one storage unit; and following the supplying of each cover to the storage unit, triggering at least one printing press by the control unit to produce the respective book block on the at least one printing press.

2. The method according to claim 1, further comprising storing each cover individually in the at least one storage unit.

3. The method according to claim 1, wherein the triggering comprises initiating the producing of each respective book block immediately after identifying the respective cover.

4. The method according to claim 1, further comprising selecting, with the control unit, one of the identified covers, and initiating the producing of the respective book block based on the selecting.

5. The method according to claim 1, further comprising respectively depositing each respective cover in a compartment of the at least one storage unit.

6. The method according to claim 1, further comprising after initiating the producing of each respective book block, controlling the conveying device to supply the respective book block to the processing device prior to removing the respective cover from the storage unit.

7. The method according to claim 1, wherein the producing each respective cover in advance of each respective book block production includes at least one of producing the book blocks internally by the arrangement itself or producing the book blocks external to the arrangement by at least one cover production device to produce the covers.

8. The method according to claim 1, wherein the supplying includes supplying the respective cover to the at least one storage unit with aid of a feeder.

9. The method according to claim 1, further comprising transporting the covers with aid of at least one conveying device from a cover production device that produces the covers to the storage unit.

10. The method according to claim 1, further comprising using the book blocks and the covers to produce at least one of a perfect-bound softcover, a perfect-bound hardcover, or a stitched printed product.

11. An arrangement for producing printed products, comprising:

at least one printing press to produce book blocks;

at least one storage unit, wherein at least one cover is supplied to the storage unit;

a device to identify each cover during depositing of the cover in the at least one storage unit, wherein the device is assigned to the at least one storage unit;

a control unit responsive to the supplying of each respective cover to the at least one storage unit to trigger production of the book blocks on at least one of the printing presses once the supplying is detected;

at least one processing device; and at least one conveying device to convey each cover from the at least one storage unit to the at least one processing device, wherein each book block is furnished with the respective cover in the processing device.

12. The arrangement according to claim 11, wherein the conveying devices aids in supplying the book blocks from the at least one printing press to the at least one processing device.

13. The arrangement according to claim 11, wherein the conveying device further comprises at least one location to takeover each book block and at least one discharge location to discharge each book block.

14. The arrangement according to claim 11, further including at least one device to produce each cover.

15. The arrangement according to claim 11, wherein the arrangement is adapted to receive covers supplied from an external location.

16. The arrangement according to claim 11, further comprising a feeder to respectively supply covers to the at least one storage unit.

17. The arrangement according to claim 11, further comprising a feeder to respectively supply covers to the at least one storage unit, wherein the device to identify each cover is arranged on the feeder.

18. The arrangement according to claim 11, wherein the at least one storage unit comprises a plurality of storage spaces for the covers, wherein the control unit is operative to request at any time each cover from any one of the storage spaces to be supplied to the at least one processing device.

19. The arrangement according to claim 11, wherein the at least one printing press comprises a digital printing press.

20. The arrangement according to claim 11, wherein the at least one storage unit comprises a storage wheel including a plurality of compartments which are respectively suppliable with each respective cover.

21. The arrangement according to claim 11, wherein the storage unit is arranged on or directly in front of the processing device.

* * * * *